US006182613B1

(12) United States Patent
McCraney

(10) Patent No.: US 6,182,613 B1
(45) Date of Patent: Feb. 6, 2001

(54) SELF-ASSEMBLY WATER HEATER ENCLOSURE AND KIT

(76) Inventor: W. Jeffrey McCraney, 26282 Mt. Diablo, Laguna Hills, CA (US) 92653

( * ) Notice: Under 35 U.S.C. 154(b), the term of this patent shall be extended for 0 days.

(21) Appl. No.: 09/524,896

(22) Filed: Mar. 14, 2000

(51) Int. Cl.[7] ..... F02B 75/00
(52) U.S. Cl. ..... 122/19.2; 122/494; 220/694.1
(58) Field of Search ..... 122/19.2, 494, 122/18.5; 220/694.1; 29/455.1; 312/236

(56) References Cited

U.S. PATENT DOCUMENTS

| | | | | |
|---|---|---|---|---|
| 1,436,298 | * | 11/1922 | Spicer | 220/694.1 |
| 1,799,744 | * | 4/1931 | Gruber | 122/19.2 |
| 2,640,567 | | 6/1953 | Pressnall . | |
| 2,906,258 | * | 9/1959 | Parker | 122/18.5 |
| 3,659,560 | * | 5/1972 | Carter | 122/494 |
| 5,146,911 | | 9/1992 | Adams . | |
| 5,533,495 | | 7/1996 | Moore, Jr. . | |
| 5,575,273 | | 11/1996 | Moore, Jr. . | |
| 5,581,953 | | 12/1996 | Ruff . | |
| 6,062,665 | * | 5/2000 | Schneider et al. | 312/265.6 |

* cited by examiner

*Primary Examiner*—Denise L. Ferensic
*Assistant Examiner*—Jiping Lu
(74) *Attorney, Agent, or Firm*—Edgar W. Averill, Jr.

(57) ABSTRACT

A water heater enclosure and kit having a box-like configuration, with a top panel, a pair of opposing side panels secured to the top panel at upper ends, front and rear braces which secure the lower ends of the side panels together, and a removable access panel. The top panel has a pair of side rails having inverted U-shaped mounting channels which receive and seat upper edges of the pair of side panels. Once seated, bendable upper-joint tabs on the side panels are bent around end flanges of the mounting channels to secure the side panels with the top panel. The front and rear braces have lower-joint tabs which extend into slots on lower corners of the side panels and are also bent to form and maintain the lower joints.

18 Claims, 2 Drawing Sheets

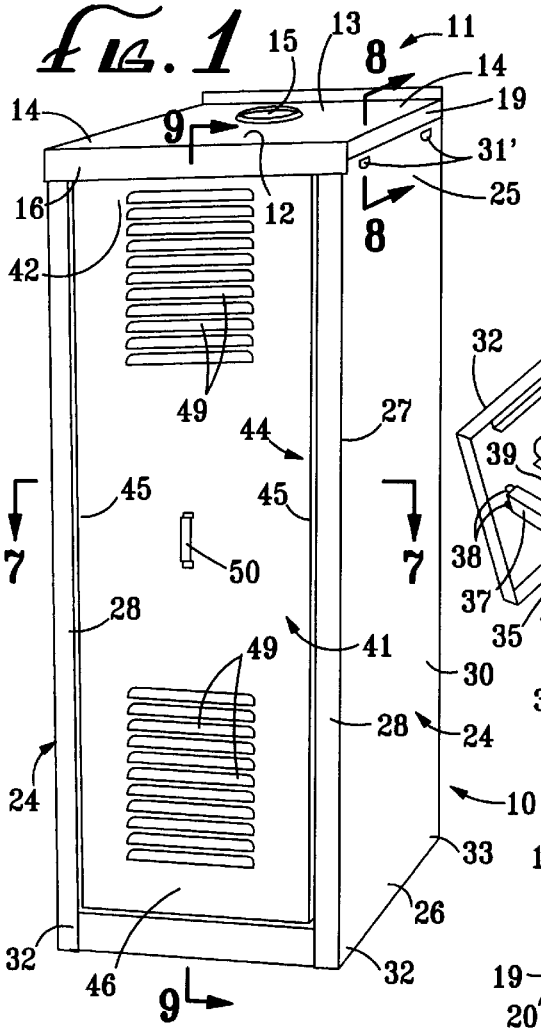
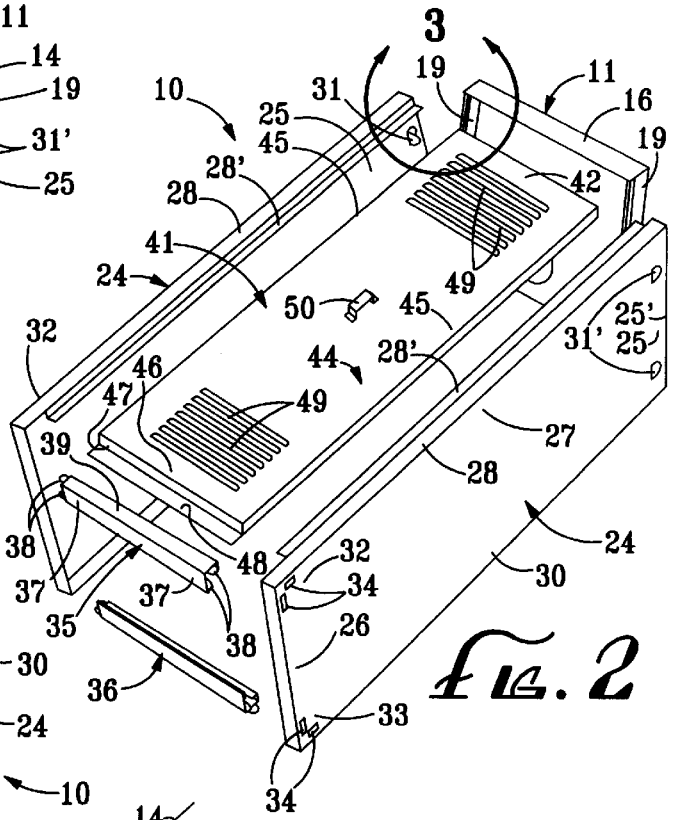
FIG. 2
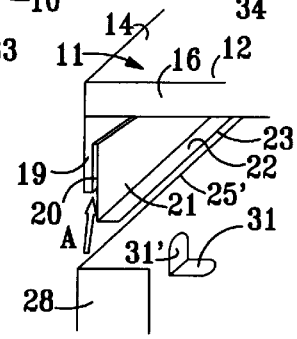
FIG. 3A
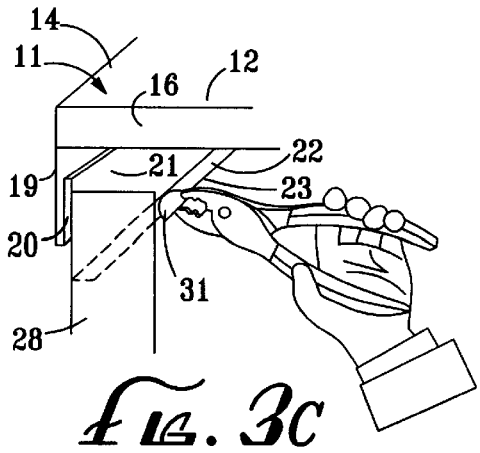
FIG. 3C
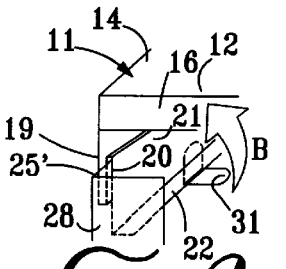
FIG. 3B

SELF-ASSEMBLY WATER HEATER ENCLOSURE AND KIT

BACKGROUND OF THE INVENTION

The field of the invention pertains to protective enclosures. The invention relates more particularly to a water heater enclosure and kit capable of being easily assembled by a novice user with little or no construction experience. Assembly is simplified and facilitated due to a minimal number of parts which are formed to durably secure together without the need for separate fasteners, such as screws, and nuts and bolts.

Various types of enclosures have been developed for protecting water heaters, especially those installed outdoors. Many of these enclosure designs, however, comprise a large number of parts, and require the use of various tools for assembly. Moreover, some water heater enclosures are intended and designed to be installed by professional contractors or service technicians, and not for the do-it-yourself homeowner.

For example, in U.S. Pat. No. 5,146,911 an exterior water heater enclosure is shown having four sidewall components (see FIG. 3) which are secured to a top portion, a base, and each other, by means of sheet metal screws. The enclosure has a vent positioned adjacent the bottom of the sidewalls for permitting air flow, and a baffle positioned over the vent to direct air downward to the gas burner of the water heater.

While the design in the '911 patent utilizes a relatively few number of parts, it requires the use of sheet metal screws to fasten the parts together. The use of screws for construction assembly can lengthen the installation time, without significantly improving reliability, durability, and/or safety of the assembled structure. Furthermore, the use of screws for assembly purposes can be arduous and labor-intensive, and may present a considerable burden for non-professional installers. It also increases the production cost of the enclosure due to the greater number of parts involved.

Additionally, in U.S. Pat. Nos. 5,533,495 and 5,575,273, a balanced flue outdoor water heater is disclosed having a water tank, a jacket surrounding the water tank, a combustion chamber containing a burner adjacent the water tank, a flue extending from the combustion chamber, and an exterior shell around the jacket. The air for the combustion chamber enters above the water heater and passes downwardly around the annular space around the jacket and exterior shell.

While the outdoor water heater in the '495 and '273 patents functions to protect itself from external/environmental elements by means of the shell and the insulating jacket, the shell and jacket are designed as a single unit with the particular water tank disclosed in the aforementioned patents. Thus, the shell and jacket cannot be independently used as an enclosure to protect common water heaters already installed and currently in use.

In summary, there is a need for a simple, inexpensive, reliable, and easy-to-install water heater enclosure and kit which protects a water heater from weather and undesired elements and conditions. Furthermore, such an enclosure and kit is needed to facilitate installation for many individuals having little or no mechanical or construction experience, while leaving little room for error and without sacrificing the quality of the installation. Thus, it would be advantageous to have a simple kit having a minimal number of parts which may be assembled quickly and easily by a non-professional installer without additional fasteners and complicated tools.

BRIEF SUMMARY OF THE INVENTION

It is an object of the present invention to provide a simple, low cost and easy-to-install water heater enclosure and kit for protectively enclosing water heaters, and which can be simply and quickly assembled and installed by both professional and non-professional installers alike.

It is a further object of the present invention to provide a reliable and durable enclosure capable of quick and easy assembly without additional fasteners or complicated tools.

The present invention is for a water heater enclosure for protectively enclosing a water heater positioned adjacent a wall. The enclosure includes a top panel having a pair of opposing side rails. Each side rail has an inverted U-shaped mounting channel with a shoulder having an end flange transversely extending therefrom. The enclosure also has a pair of opposing side panels, each having an upper edge at an upper end seated in the corresponding inverted U-shaped mounting channel of the pair of side rails. Each side panel also has at least one upper-joint tab at the upper end extending adjacent the corresponding end flange of the pair of side rails. The upper-joint tab is preferably secured to the end flange by conformably bending around the end flange. Additionally, the enclosure includes at least a front brace having a pair of opposing ends connected to lower front corners of the pair of opposing side panels by joint securing means. In this manner, the front brace, a front end of the top panel, and forward ends of the pair of opposing side panels, together define an access perimeter which surrounds an access opening into the enclosure. And finally, the enclosure includes an access panel having means for detachably securing the access panel to the access perimeter to close the access opening. Furthermore, the present invention is for a water heater enclosure kit including the component parts described above which are adapted to be assembled together by a user.

BRIEF DESCRIPTION OF THE DRAWINGS

FIG. 1 is a perspective view of the fully assembled water heater enclosure.

FIG. 2 is an exploded perspective view of the water heater enclosure.

FIG. 3A is an enlarged view of the upper joint taken along the circle 3 of FIG. 2, prior to seating the upper edge of the side panel in the inverted U-shaped mounting channel of the top panel.

FIG. 3B is an enlarged view of the upper joint similar to and following FIG. 3A, with the upper edge of the side panel seated in the inverted U-shaped mounting channel of the top panel.

FIG. 3C is an enlarged view of the upper joint similar to and following FIG. 3B, with the upper-joint tab secured to the end flange.

DETAILED DESCRIPTION OF THE PREFERRED EMBODIMENTS

Figure 4:
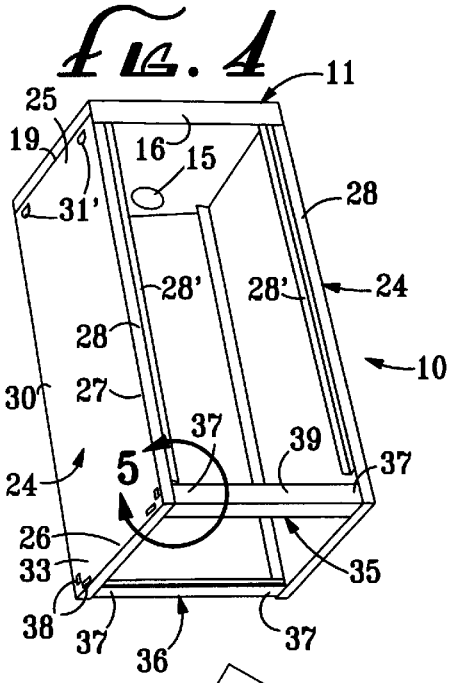
FIG. 4 is a perspective view of the enclosure with the access panel removed.

Referring now to the drawings, FIG. 1 shows a perspective view of the water heater enclosure and kit, generally indicated at reference character 10, as finally assembled. As can be seen, the water heater enclosure 10 has a generally box-like shape that is elongated in a vertical direction to accommodate a water heater (100 in FIG. 7) therein. Moreover, the enclosure 10 is preferably designed to accommodate a water heater which is positioned adjacent a wall (101 in FIG. 7). It is notable that while the water heater enclosure 10 is typically for outdoor use, and the wall consequently an exterior wall, it is not limited only to such. The adjacent wall may be an interior wall, such as in a water heater closet, or against a wall in a garage. The enclosure 10 is preferably made of metallic panels, such as galvanized steel, but may comprise any rigid material capable of withstanding weather conditions.

Details of the water heater enclosure 10 can be best seen in FIGS. 1 and 2. In particular, FIG. 2 shows an exploded perspective view of the enclosure 10, illustrating the dearth of parts that comprise the enclosure 10. In a preferred embodiment, the enclosure 10 comprises a top panel, generally indicated at reference character 11, secured to a pair of opposing side panels, generally indicated at reference character 24. Furthermore, the preferred embodiment of the enclosure 10 comprises both a front brace, generally indicated at 35, and a rear brace, generally indicated at 36, which operate to rigidly secure lower ends 26 of the pair of side panels 24.

As can be best seen in FIGS. 1, 2, 3A–C, and 8, the top panel 11 has a pair of opposing side rails 19 at side ends 14, with each side rail 19 having an inverted U-shaped mounting channel (20 in FIGS, 3A–C, and 8). Furthermore, each mounting channel 20 has a shoulder 21 having an end flange 22 extending transversely therefrom. The shoulder 21 has a vertical orientation, and the end flange 22, consequently, is oriented in a lateral direction to form a generally L-shaped configuration with the shoulder 21 (see FIG. 8). As can be seen in FIGS. 3A–C and 8, the shoulder 21 is preferably inwardly positioned relative to the corresponding inverted U-shaped mounting channel 20, and the end flange 22 is preferably inwardly directed towards the center of the enclosure 10. Preferably, the top panel 11 also has a head rail 16 at a front end 12. The head rail 16 functions in part to retain an access panel 41 (see discussion below). And preferably still, the top panel 11 also includes an aperture 15 having a generally circular shape for receiving a vent pipe extending from a water heater (100 in FIG. 7).

Figure 8:
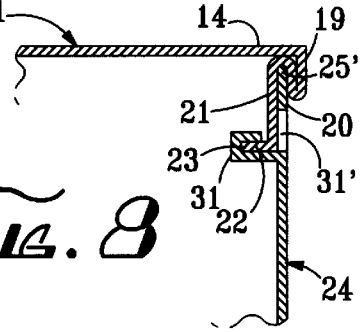
FIG. 8 is a cross-sectional view of the enclosure taken along the line 8—8 of FIG. 1, showing in detail the seating of the upper edge of a side panel in an inverted U-shaped mounting channel of the top panel.

As can be seen in the figures, the pair of opposing side panels 24 have a generally elongated, rectangular configuration, each with an upper end 25, a forward end 27, a rearward end 30, and a lower end 26. The upper end 25 has an upper edge 25' capable of seating in the corresponding inverted U-shaped mounting channel 20. As best illustrated in FIGS. 3A and 8, the upper edge 25' of the side panel 24 is capable of insertion into the corresponding mounting channel 20 from below in a vertical direction, as indicated by reference arrow A. When the upper edge 25' seatably rests against and inside the mounting channel 20, the end flange 22 is positioned adjacent at least one upper-joint tab 31. The upper-joint tab 31 is preferably formed by partially cutting the wall of the side panel 24, and subsequently bending it to coextensively extend alongside the end flange 22. Consequently, a small cutout hole 31' is formed on the side panel 24 in the shape of the upper-joint tab 31. As can be seen in FIGS. 3B and 8, once the upper edge 25' of the side panels 24 is seated in the inverted U-shaped mounting channel 20, the upper-joint tab 31 is secured to the end flange 22 preferably by conformably bending it around and over the end flange 22, as indicated by reference arrow B in FIG. 3B. As shown in FIG. 3C, plyers may be used to perform and complete the bending operation of the upper-joint tab 31. Alternatively, if a sufficiently supple material is utilized, a user may bend the upper-joint tab 31 by hand into the final position. FIG. 8 illustrates a cross-section of the top panel 11 and one side panel 24 when finally assembled and secured.

Figure 5:
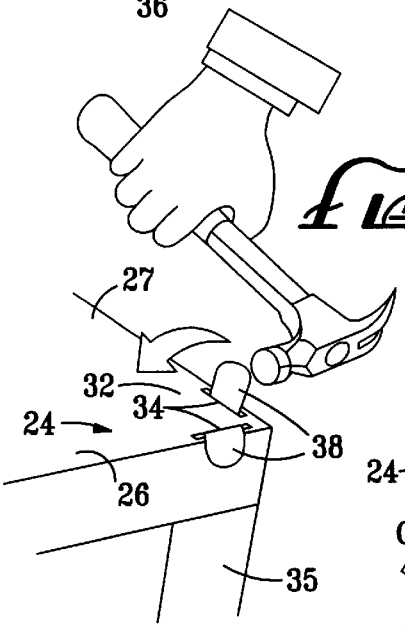
FIG. 5 is an enlarged view of the lower joint taken along the circle 5 of FIG. 4, illustrating the securing of the lower-joint tabs to the side panel.
Figure 9:
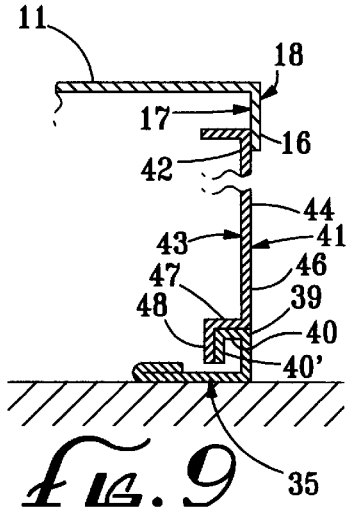
FIG. 9 is a cross-sectional view of the enclosure taken along the line of 9—9 of FIG. 1, showing in detail the contacts made by the access panel with the top panel and the front brace.

As can be best seen in FIG. 4, the enclosure 10 further includes a front brace 35 for rigidly securing together the lower front corners 32 of the pair of side panels 24, and a rear brace 36 for rigidly securing together the lower rear corners 33 of the pair of side panels 24. Each brace 35 and 36 has a pair of opposing ends 37 connected to the lower corners 32, 33 of the pair of side panels 24 by joint securing means 38. Preferably, the joint securing means 38 is at least one lower-joint tab 38 extending from each opposing end 37 of each brace 35 and 36. The lower-joint tabs 38 extend into corresponding slots 34 (see FIGS. 2, 5) on the lower corners 32, 33 which are adapted to receive the at least one lower-joint tab 38 for establishing a securing relation therewith. Furthermore, as can be seen in FIG. 9, the front brace 35 has a foot rail 39 having a lateral shelf component 40 with an inner portion 40'. The inner portion 40' may be a flange which functions to prevent outward movement of the access panel 41 (see discussion below). The front brace 35, together with forward ends 27 of the side panels 24, and the head rail 16 of the top panel 11, form an access perimeter which surrounds an access opening leading into the enclosure 10.

It is notable that while the front brace 35 is an essential component of the enclosure 10 which functions to vertically support the access panel 41, the enclosure 10 would be able to function without the rear brace 36. However, as shown in FIG. 4, the enclosure 10 preferably includes the rear brace 36 in order to provide greater unit rigidity and structural support to the enclosure 10, particularly the frame of the enclosure 10. In some applications, e.g. where a pre-installed water heater is to be enclosed, the rear brace 36 may be omitted from assembly in order to enable lateral sliding of the assembled enclosure 10 past the water heater (100 in FIG. 7). Alternatively, the rear brace 36 may be installed subsequent to positioning the enclosure 10, without the rear brace 36, past the water heater. In any case, the rear portion of the enclosure 10, which is bordered by the back end 13 of the top panel 11, the rearward ends 30 of the pair of side panels 24, and the rear brace 36, remains open without additional paneling, and is contactedly positioned against the wall (see FIG. 7). Optionally, as shown in FIG. 7, common fasteners 51, such as nails or screws, may be used to permanently secure the rear portion of the enclosure 10 to the wall 101.

Figure 7:
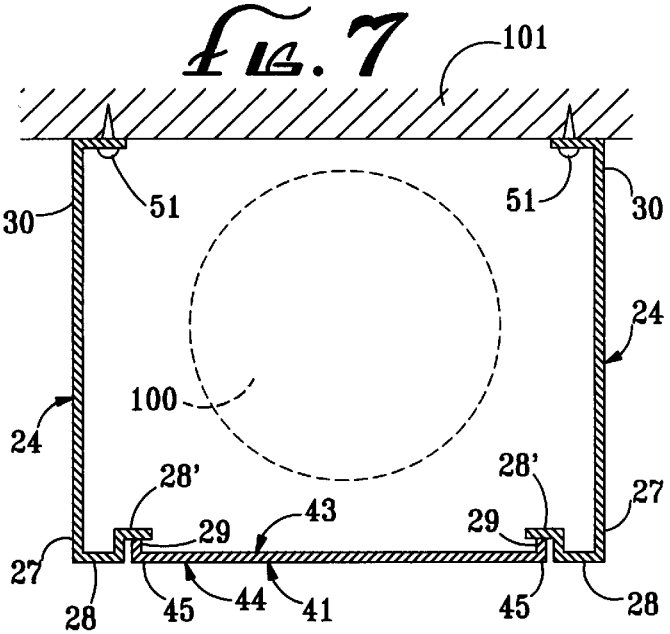
FIG. 7 is a cross-sectional view of the enclosure taken along the line 7—7 of FIG. 1, showing in detail the contact between the access panel and the pair of stopper flanges.
Figure 6:
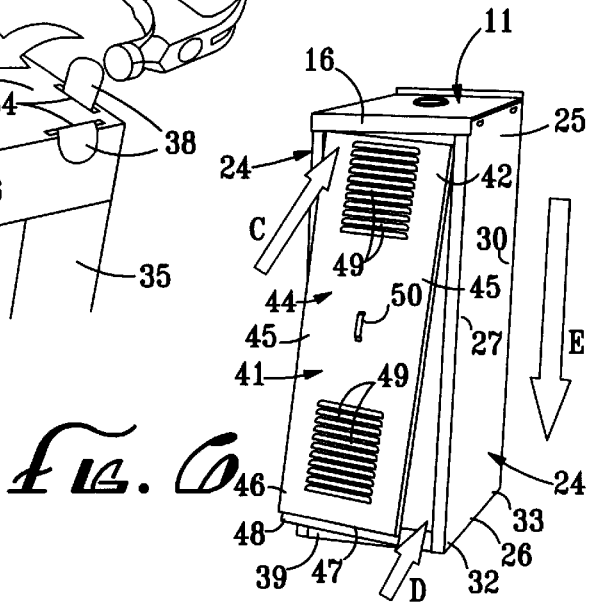
FIG. 6 is a perspective view of the enclosure illustrating the mounting of the access panel to the frame portion.

And finally, as shown in FIGS. 1, 2, 6, 7, and 9, the enclosure 10 includes a removable access panel 41 to gain access into the finally assembled and installed enclosure 10. The access panel 41 also has a generally rectangular configuration with an upper portion 42, a lower portion 46, and opposing side portions 45. FIG. 6 illustrates the positioning and installation of the access panel 41 onto the rigid frame structure of the enclosure 10 shown in FIG. 4. The upper portion 42 is first inserted under the head rail 16 (see FIG. 9) as indicated by arrow C, such that the outer surface 44 of the access panel 41 contacts the inner surface 17 of the head rail 16. Next, the lower portion 46 is sufficiently raised past the front brace 35 as indicated by reference arrow D, and lowered onto the front brace 35. As shown in FIG. 9, the lower portion 46 has a lateral base 47 which is adapted to contact and be vertically supported by the lateral shelf component 40 of the front brace 35. Further a base flange 48 extends below the lateral base 47 to contact an inner portion 40' of the shelf component 40. In this manner, both the inner surface 17 of the top panel 11 and the inner portion 40' of the front brace 35 operate to prevent outward movement of the access panel 41 when installed. Furthermore, as shown in FIG. 7, the stopper flanges 28' function as a barrier to prevent the access panel 41 from inward movement into the enclosure 10 when the side portions 45 of the access panel 41 contact the outer surfaces 29 of the stopper flanges 28'. The access panel 41 also has a handle 50 on the outside surface 44 to facilitate removal and installation of the access panel 41. Furthermore, the access panel 41 has a plurality of air vents 49, preferably on the access panel 41 to allow air flow into the enclosure 10 for gas-flame water heating units. However, the air vents 50 may alternatively be placed on the opposing side panels 24 as well, or in lieu thereof.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. An enclosure for protectively enclosing a water heater positioned adjacent a wall, said enclosure comprising:

a top panel having a pair of opposing side rails, each side rail having an inverted U-shaped mounting channel with a shoulder having an end flange transversely extending therefrom;

a pair of opposing side panels, each having an upper edge at an upper end seated in the corresponding inverted U-shaped mounting channel of said pair of side rails, and at least one upper-joint tab at the upper end extending adjacent the corresponding end flange of the pair of side rails and establishing a securing relation therewith;

a front brace having a pair of opposing ends connected to lower front corners of said pair of opposing side panels by joint securing means, wherein said front brace, a front end of said top panel, and forward ends of said pair of opposing side panels, together define an access perimeter surrounding an access opening into said enclosure; and an access panel having means for detachably securing said access panel to the access perimeter to thereby close the access opening.

2. The enclosure as in claim 1, wherein the at least one upper-joint tab is an integral, partially-cut and bent portion of the corresponding side panel.

3. The enclosure as in claim 1, wherein the at least one upper-joint tab is secured to the corresponding end flange by bendably conforming around the corresponding end flange.

4. The enclosure as in claim 1, wherein said joint securing means comprises at least one lower-joint tab extending from each end of said front brace, and corresponding slots on said lower front corners adapted to receive said at least one lower-joint tab for establishing a securing relation therewith.

5. The enclosure as in claim 1, wherein said means for detachably securing said access panel to the access perimeter includes a head rail connected to the front end of said top panel for inhibiting outward movement of an upper portion of said access panel when the upper portion is positioned against an inner portion of the head rail, a stopper flange connected to the forward end of each of said pair of opposing side panels for inhibiting inward movement of opposing side portions of said access panel when the opposing side portions are positioned against outer portions of the stopper flanges, and a foot rail connected to said front brace, said foot rail having a lateral shelf component for supporting said access panel and inhibiting outward movement of a lower portion of said access panel when the lower portion is positioned against an inner portion of the shelf component.

6. The enclosure as in claim 1, wherein said pair of side panels have rear mounting flanges at rearward ends thereof capable of being secured to said wall by fastening means.

7. The enclosure as in claim 1, further comprising a rear brace having a pair of opposing ends connected to lower rear corners of said pair of opposing side panels by said joint securing means.

8. The enclosure as in claim 1, wherein said top panel has an aperture.

9. The enclosure as in claim 1, wherein said access panel has a plurality of vents.

10. An enclosure kit having component parts capable of being assembled by a user for enclosing a water heater, said enclosure kit comprising the combination of:

a top panel having a pair of opposing side rails, each side rail having an inverted U-shaped mounting channel with a shoulder having a securing flange transversely extending therefrom;

a pair of opposing side panels, each having an upper edge at an upper end to be seated in the corresponding inverted U-shaped mounting channel of said pair of side rails, and at least one upper-joint tab at the upper end to be secured to the corresponding end flange subsequent to seating the upper edges of said pair of opposing side panels in said inverted U-shaped mounting channels;

a front brace having a pair of opposing ends adapted to be connected to lower front corners of said pair of opposing side panels by joint securing means, wherein said front brace, a front end of said top panel, and forward ends of said pair of opposing side panels, may together define an access perimeter surrounding an access opening when finally assembled; and an access panel adapted to be detachably secured to the access perimeter for closing the access opening.

11. The enclosure kit as in claim 10, wherein the at least one upper-joint tab is an integral, partially-cut and bent portion of the corresponding side panel.

12. The enclosure kit as in claim 10, wherein the at least one upper-joint tab is to be secured to the corresponding end flange by bendably conforming around the corresponding end flange.

13. The enclosure kit as in claim 10, wherein said joint securing means comprises at least one lower-joint tab extending from each end of said front brace, to be inserted into corresponding slots on said lower front corners adapted to receive said at least one lower-joint tab for establishing a securing relation therewith.

14. The enclosure kit as in claim 10, wherein said means for detachably securing said access panel to the access perimeter includes a head rail connected to the front end of said top panel for inhibiting outward movement of an upper portion of said access panel when the upper portion is positioned against an inner portion of the head rail, a stopper flange connected to the forward end of each of said pair of opposing side panels for inhibiting inward movement of opposing side portions of said access panel when the opposing side portions are positioned against outer portions of the stopper flanges, and a foot rail connected to said front brace, said foot rail having a lateral shelf component for supporting said access panel and inhibiting outward movement of a lower portion of said access panel when the lower portion is positioned against an inner portion of the shelf component.

15. The enclosure kit as in claim 10, wherein said pair of side panels have rear mounting flanges at rearward ends thereof capable of being secured to said wall by fastening means.

16. The enclosure kit as in claim 10, further comprising a rear brace having a pair of opposing ends to be connected to lower rear corners of said pair of opposing side panels by said joint securing means.

17. The enclosure kit as in claim 10, wherein said top panel has an aperture.

18. The enclosure kit as in claim 10, wherein said access panel has a plurality of vents.

* * * * *